United States Patent [19]

Shields et al.

[11] 4,365,798

[45] Dec. 28, 1982

[54] NOVELTY MIRROR

[76] Inventors: Robert M. Shields; Ted A. Shields, both of 4815 Topeka Dr., Tarzana, Calif. 91356

[21] Appl. No.: 279,035

[22] Filed: Jun. 30, 1981

[51] Int. Cl.[3] ..... A63J 3/00

[52] U.S. Cl. ..... 272/8 M; 350/288

[58] Field of Search ..... 272/8 M, 8.5, 13; 46/1 R; 40/900, 219; 350/98, 298, 288, 289

[56] References Cited

U.S. PATENT DOCUMENTS

| | | | |
|---|---|---|---|
| 1,268,010 | 5/1918 | Hudgen | 272/8 M |
| 1,979,119 | 10/1934 | Radzinsky | 350/288 X |
| 4,273,418 | 6/1981 | Gillespie et al. | 350/289 |

*Primary Examiner*—Mickey Yu

*Attorney, Agent, or Firm*—Maky, Renner, Otto & Boisselle

[57] ABSTRACT

A toy in the form of a novelty mirror has three horizontally aligned and equally spaced holes in the upper portion with the farthest spaced holes being spaced approximately the distance between the eyes of one of the users. The mirror may be hand held and reflective on both sides so that when held between two opposed viewers with the holes properly aligned with the eyes of the viewers, one viewer's face appears in the mirror with the eyes of the opposite viewer. This transposition of eye features may occur simultaneously for both viewers.

7 Claims, 3 Drawing Figures

NOVELTY MIRROR

This invention relates generally as indicated to a toy and more particularly to a novelty mirror provided with holes, which when held in a position to align the holes with another person's eyes, transposes the eyes of the other person into the reflected face of the viewer.

SUMMARY OF THE INVENTION

The present invention is a toy in the form of a novelty mirror which has utility inter alia as an amusement device. It can also be used as a device to permit the viewer to see what the viewer's face would appear as with the eyes of another. The mirror may be used by two persons which when properly positioned will transpose the eyes of the other to the face of the viewer. The mirror in its preferred form comprises two pieces of transparent plastic or glass which may be cemented together with the reflective surface therebetween, which is, preferably reflective on both sides. The mirror is provided with three holes in the upper half with the farthest apart holes being spaced approximately the distance between the eyes of one of the viewers. A third hole is centered between the two outer holes and the holes are horizontally aligned.

The mirror may be hand held and in use it is positioned by one person who aligns the mirror so that the outer holes are lined up with another person's eyes. Then, with the aid of the middle hole, a viewer sees eyes transposed in their face. This same visually startling occurrence happens concurrently with both participants when the mirror is properly positioned.

It is accordingly a principle object of the present invention to provide a toy in the form of a mirror which will transpose the eye features of a viewer with another.

Another principle object is the provision of a novelty mirror which includes three holes therethrough.

A further important object is the provision of such mirror wherein the holes are equally spaced and horizontally aligned in the upper portion of the mirror with the outermost holes being adapted to be lined up with the eyes of a viewer.

Other objects and advantages of the present invention will become apparent as the following description proceeds.

To the accomplishment of the foregoing, the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE ILLUSTRATED EMBODIMENT

Figure 1:
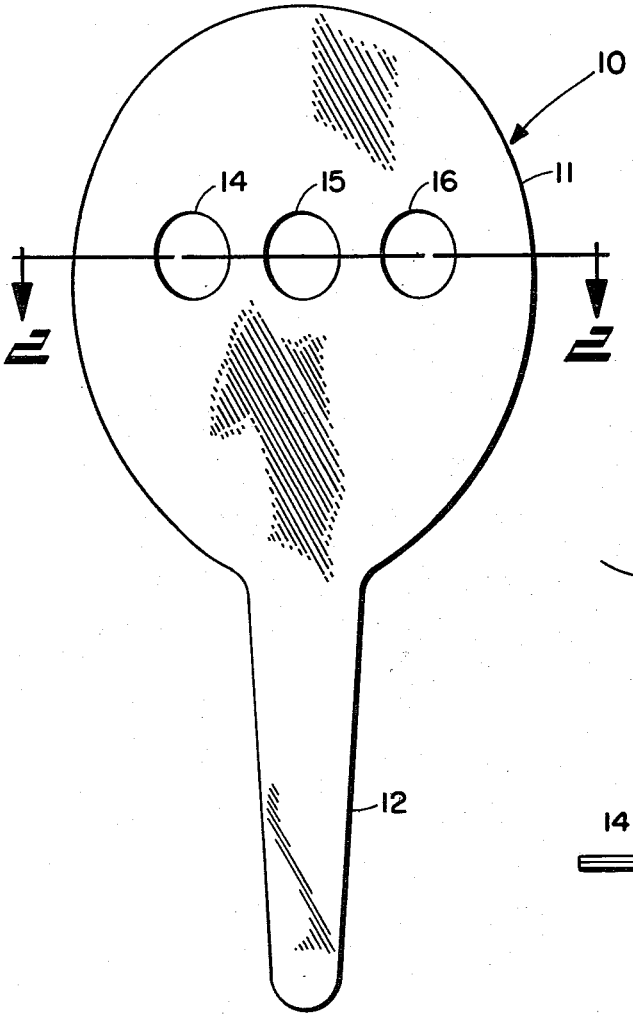
FIG. 1 is an elevation illustrating one side of the mirror in accordance with the present invention.

Referring first to FIG. 1, there is illustrated a mirror 10 which includes a somewhat oval upper or face portion 11 and a lower downwardly projecting handle 12. The oval face portion 11 is approximately the same size as the face of a viewer. In the upper portion or top half of the face portion 11 are three holes seen at 14, 15 and 16 which extend completely through the mirror. In other words, one could place a finger through such holes.

The holes are horizontally aligned and of substantially the same circular or oval configuration although other hole configurations may be employed. The two holes 14 and 16 which are spaced farthest apart are spaced approximately the distance of one viewer's eyes and the center hole 15 is horizontally aligned with the other holes and centered therebetween.

The mirror consists of two pieces of transparent plastic seen at 18 and 19, each of which is provided with a silvery, metallic or amalgam reflective backing seen at 20. The two pieces may simply be cemented together. With such construction, both sides of the mirror are then reflective. Each piece is, of course, provided with holes which line up with the holes in the other piece to form the holes 14, 15 and 16. It will be appreciated that the transparent plastic could as easily be glass.

Figure 3:
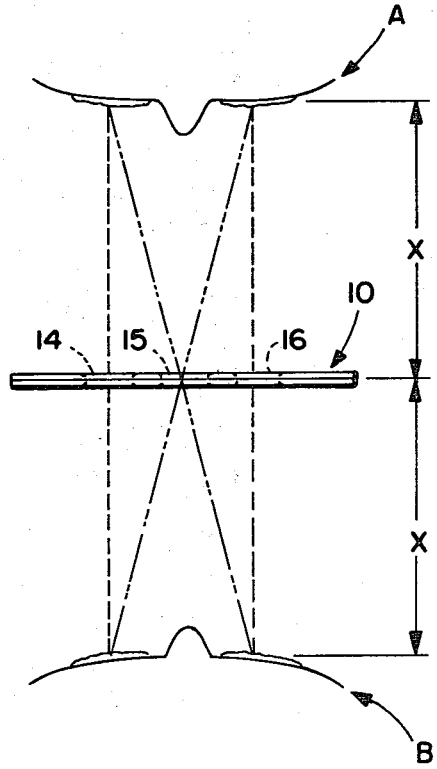
FIG. 3 is a schematic top plan view of the mirror held in position between two viewers.
Figure 2:
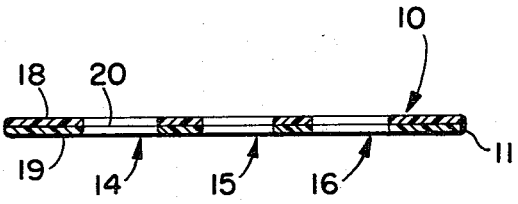
FIG. 2 is a horizontal section through the mirror taken substantially from the line 2—2 of FIG. 1.

Referring now to FIG. 3, it will be seen that the mirror 10 may be held in position between two viewers A and B. The mirror is held in position by one viewer who lines up the holes in the mirror with the other viewer's eyes. Thus the two outside holes 14 and 16 are lined up with each viewers eyes. With the aid of the middle hole, the viewer then sees his or her own face reflected with the other person's eyes transposed into their own face. This startling and amusing occurrence happens simultaneously with both participants or viewers. As noted from FIG. 3, the distance "X" that the mirror is held from the face of each viewer A and B may preferably be the same and may vary from approximately four inches to two feet.

It will also be appreciated that the mirror may be reflective on one side only so that only one of the two viewers will see the other person's eyes on their own face. Also, it will be appreciated that one of the viewers may be a picture of someone else's face.

In any event, it can now be seen that there is provided a toy or novelty mirror which creates an image of the face of the viewer with the eye features of someone else.

We claim:

1. A novelty mirror which includes three holes therethrough wherein the holes farthest apart are spaced approximately the distance between the eyes of the user and at least one reflective surface of sufficient size to reflect a substantial portion of a human face, said holes include a center hole equally spaced between said farthest apart holes and said three holes are in substantial horizontal alignment.

2. A mirror as set forth in claim 1 wherein said mirror is the approximate size of a human face.

3. A mirror as set forth in claim 2 wherein such holes are holes of the same size.

4. A mirror as set forth in claim 1 wherein said mirror is hand held and both sides are reflective.

5. A mirror as set forth in claim 4 wherein said mirror includes an optically oppositely reflective surface encased in transparent plastic.

6. A mirror as set forth in claim 1 wherein said mirror is the approximate size of a human face.

7. A mirror as set forth in claim 6 wherein such holes are of the same approximate shape.

* * * * *